US008044627B2

(12) United States Patent
Wenzel et al.

(10) Patent No.: US 8,044,627 B2
(45) Date of Patent: Oct. 25, 2011

(54) DEVICE FOR CONTROLLING THE MOVEMENT OF FURNITURE PARTS WHICH CAN BE MOVED WITH RESPECT TO ONE ANOTHER, AND A PIECE OF FURNITURE

(75) Inventors: Holger Wenzel, Lindau (DE); Peter Kropf, Hard (AT); Helmut Wetschko, Klaus-Weiler (AT)

(73) Assignees: Grass GmbH, Hochst (AT); Küster Automotive Door Systems GmbH, Ehringshausen (DE)

( * ) Notice: Subject to any disclaimer, the term of this patent is extended or adjusted under 35 U.S.C. 154(b) by 392 days.

(21) Appl. No.: 12/244,859

(22) Filed: Oct. 3, 2008

(65) Prior Publication Data

US 2009/0134754 A1 May 28, 2009

Related U.S. Application Data

(63) Continuation of application No. PCT/EP2007/003032, filed on Apr. 4, 2007.

(30) Foreign Application Priority Data

Apr. 4, 2006 (DE) ..... 20 2006 005 579 U

(51) Int. Cl.
*G05B 5/00* (2006.01)

(52) U.S. Cl. ..... 318/468; 318/466; 318/450

(58) Field of Classification Search ..... 318/468, 318/466, 450, 646, 9; 312/319.5, 319.1
See application file for complete search history.

(56) References Cited

U.S. PATENT DOCUMENTS

| | | | | |
|---|---|---|---|---|
| 6,109,774 | A | 8/2000 | Holmes et al. | |
| 6,685,288 | B1 | 2/2004 | MacMillan | |
| 2006/0261769 | A1 * | 11/2006 | Rees | 318/450 |

FOREIGN PATENT DOCUMENTS

| | | | |
|---|---|---|---|
| DE | 42 01 969 | A1 | 7/1993 |
| DE | 101 05 756 | A1 | 8/2001 |
| DE | 1 374 732 | A1 | 1/2004 |
| DE | 203 08 256 | U1 | 6/2004 |
| DE | 20 2004 007 170 | U1 | 9/2004 |
| DE | 007 723 | U1 | 6/2005 |
| DE | 20 2005 013 128 | U1 | 12/2005 |
| DE | 10 2004 045 568 | A1 | 3/2006 |
| DE | 20 2005 018 353 | U1 | 3/2006 |
| DE | 10 2004 045 567 | A1 | 4/2006 |
| DE | 20 2005 006 945 | U1 | 6/2006 |
| DE | 20 2006 002 103 | U1 | 8/2006 |
| DE | 20 2006 012 976 | U1 | 12/2006 |
| DE | 20 2006 012 656 | U1 | 2/2007 |
| DE | 20 2005 021 123 | U1 | 3/2007 |

(Continued)

*Primary Examiner* — Karen Masih
(74) *Attorney, Agent, or Firm* — Burr & Brown

(57) ABSTRACT

The invention relates to a piece of furniture and to a device for controlling the movement of furniture parts which can be moved with respect to one another, having a drive unit by means of which a first furniture part can be moved relative to a second furniture part, in a driven manner, via a monitoring unit for monitoring the movement of said first furniture part. According to the invention, the monitoring unit is designed such that, after an initiating action by the monitoring unit, the first furniture part is moved to a predetermined position and is stopped there, with the predetermined position differing from a final position of the first furniture part.

14 Claims, 1 Drawing Sheet

FOREIGN PATENT DOCUMENTS

| | | | |
|---|---|---|---|
| DE | 10 2006 004 559 | B3 | 4/2007 |
| EP | 1 323 363 | A1 | 7/2003 |
| EP | 1 323 364 | A1 | 7/2003 |
| WO | 2004/100717 | A1 | 11/2004 |
| WO | 2004/100718 | A1 | 11/2004 |
| WO | 2005/058092 | A1 | 6/2005 |

* cited by examiner

DEVICE FOR CONTROLLING THE MOVEMENT OF FURNITURE PARTS WHICH CAN BE MOVED WITH RESPECT TO ONE ANOTHER, AND A PIECE OF FURNITURE

CROSS REFERENCE TO RELATED APPLICATIONS

This application is a continuation of International Application No. PCT/EP2007/003032, filed Apr. 4, 2007, which designated the United States, and claims the benefit under 35 USC §119(a)-(d) of German Application No. 20 2006 005 579.7 filed Apr. 4, 2006, the entireties of which are incorporated herein by reference.

FIELD OF THE INVENTION

The invention relates to a device for controlling the movement of furniture parts which can be moved with respect to one another, and to a piece of furniture including the device.

BACKGROUND OF THE INVENTION

Devices for controlling furniture parts which can be moved in a driven manner, and in which a first furniture part can be moved in a driven manner relative to a second furniture part with the aid of a drive unit, and corresponding pieces of furniture, are already known.

SUMMARY OF THE INVENTION

The object of the invention is to provide devices for controlling the movement of furniture parts and pieces of furniture which can be moved with respect to one another, which devices and pieces of furniture are distinguished by comparatively good convenience of use and comparatively flexible use of the pieces of furniture for their individual purpose.

The invention is based on a device for controlling the movement of furniture parts which can be moved with respect to one another, having a drive unit by means of which the first furniture part can be moved in a driven manner relative to the second furniture part, and a monitoring unit for monitoring the movement of the first furniture part. One major aspect of the invention is that the monitoring unit is designed such that, after an initiating action by the monitoring unit, the first furniture part is moved to a predetermined position and is stopped there, with the predetermined position differing from a final position of the first furniture part. This allows the first furniture part to be used particularly conveniently, to be moved in an uncomplicated manner for an operator, and to be operated advantageously in the selected predetermined position. In particular, a manual action which can be carried out by an operator in order to move the first furniture part can be avoided or can be carried out comparatively easily. For example, it is sufficient for movement of the first furniture part for the operator just to initiate the initiation action of the monitoring unit, for example manually or using some other body part.

In principle, the initiation action of the monitoring unit can also be carried out indirectly with respect to the monitoring unit, for example by interaction with other devices such as a mechanical initiation unit. The expression the initiation action of the monitoring unit can also mean the start of the movement of the first furniture part from a rest position. The actual movement monitoring, in particular the positioning of the first furniture part at a desired predetermined position, is carried out by the monitoring unit.

It is particularly advantageous that the first furniture part can be moved, considered over the maximum possible movement distance, by the monitoring unit to a defined, predetermined position, which is at a distance from the final position. This is because, for practical reasons, it is frequently advantageous for the first furniture part not to be moved to the final position, for example to a completely open position of the first furniture part relative to the second furniture part, during each operation, but to be moved to a predetermined position which differs from the final position.

For example, in the case of a piece of furniture or a piece of kitchen furniture with drawers which are accommodated such that they can move in a housing, the device according to the invention can be used to move the relevant drawer, via the monitoring unit in order to monitor the movement of the drawer and/or by means of the drive unit, from a completely closed position to a partially open position, with the partially open position corresponding to the predetermined position. A drawer, for example, can thus in each case be moved to precisely the desired opening state which corresponds to an ideal open position for the majority of the occasions on which the drawer is used. For example, the objects which are used most frequently can be removed from the drawer and placed in it in this opening state.

In another embodiment, the monitoring unit is designed such that the first furniture part is moved, in a driven manner, to the predetermined position. This allows the first furniture part to be moved to the predetermined position particularly quickly and effectively. If required, the movement of the first furniture part to the predetermined position can be carried out, by means of different presets, in a comparatively short time or in accordance with a predetermined movement pattern. With a movement of the first furniture part such that it is driven to the predetermined position, it is also possible to apply comparatively high forces for driving the first furniture part to the predetermined position, and this may be particularly advantageous in the case of heavily loaded and/or comparatively solid first furniture parts, for example in the case of relatively broad drawers with a heavy load. For example, the furniture part movement can be carried out comparatively quickly to the desired intended position, which would otherwise be possible by one person only with a certain amount of effort or, for example, might be impossible for children.

The monitoring unit can advantageously be designed such that the first furniture part is moved in a driven manner over a distance that is less than a maximum distance that the first furniture part can move relative to the second furniture part. If required, this makes it possible for the monitoring or drive unit and further parts of the device for controlling movement to be designed to be comparatively compact and relatively simple, since no precautions for a drive effect need be provided in particular over this maximum distance. It is thus feasible for the first furniture part to be moved in a driven manner from the completely closed position just over a comparatively short movement distance from the closed position, and then to be moved without any further drive power to the predetermined position, and to be stopped there. By way of example, withdrawable, ejection and pushing-out devices are thus feasible, which move the first furniture part in a driven manner, for example only as far as is necessary in order to move the first furniture part to the predetermined position, taking into account, for example, friction losses and any load.

In another embodiment, the monitoring unit is designed such that the first furniture part is moved from a closed position to the predetermined position. For most situations, and those which are particularly relevant in practice, it is desirable to move the first furniture part from the closed position to a specific partially open position, for example, half or three-quarters open.

In principle, the device according to the invention can be used to move the first furniture part from any possible position on its movement path relative to the second furniture part to a position which differs from this, or to the predetermined position.

In one particularly preferred embodiment of the invention, the monitoring unit is designed such that the first furniture part is moved after a variable time from the predetermined position to a further position, and is stopped there. This arrangement makes it possible to take account of the situation which occurs particularly frequently, in which the first furniture part is intended to remain at the predetermined position for a certain, generally comparatively short, time. For the rest of the time, and in the relatively long time between two usage states of the first furniture part and until a next access to the first furniture part, the first furniture part can remain in the further position, for example, a closed or parked position. By way of example, this may be a completely closed position or a position in which the first furniture part is admittedly not completely closed but is located at least largely in a moved-in position in the second furniture part, which is spatially comparatively unproblematic.

In a further preferred embodiment of the invention, the monitoring unit is designed such that the further position is a predetermined position which differs from a final position of the first furniture part. This makes it possible, for example, to define a further desired or user-friendly predetermined position of the first furniture part, at which the first furniture part is stopped. For example, it is feasible for the first furniture part to be moved from the completely closed position to a first predetermined position, where it is stopped, and can be used by a user in this position, for example, with the user taking an object from the drawer, when this relates to a drawer, in its central area. After a specific time interval, the drawer is then moved to a position which is opened or closed further with respect to the first predetermined position, and is stopped there. In the second predetermined position, it is then, for example, still possible to access the drawer, and in the case of a position in which it has been moved in further with respect to the first predetermined position it is then possible, for example, to access only an area of the drawer which is located further forwards, although this can frequently be sufficient.

The monitoring unit is preferably designed such that the further position is a closed position or open position. This makes it possible, for example, for the first furniture part to be moved to the closed position where it is therefore parked in a position which is spatially not critical. For example, if the first furniture part is moved to the predetermined position comparatively rarely, it is also advantageous for the first furniture part subsequently to be moved to the completely closed position, and therefore to remain there for most of the time. Situations are likewise conceivable in which it is advantageous for the first furniture part to be moved to the completely open position once the predetermined position has been reached, and to stop there.

In a further preferred embodiment of the invention, the monitoring unit is designed such that the further position is a position between the closed position and the open position. This makes it possible for the first furniture part to be moved individually through any desired number of different predetermined, respectively matched, further positions. This allows appropriately equipped items of furniture to be designed to be particularly flexible and user-friendly.

Furthermore, it is advantageous for the monitoring unit to be designed such that the first furniture part can be stopped during the movement to a predetermined position, before reaching the predetermined position. This allows a movement pattern of the first furniture part to be varied at any time and at short notice. In addition, for example, in exceptional situations it may be necessary to stop the first furniture part during its movement to a predetermined position, for example in order to avoid a collision with an object or with a person, or because, in a specific situation, there is no need for the first furniture part to move or to move out so far that it reaches the predetermined position.

In addition, the monitoring unit is preferably designed such that a stopping position which was assumed most recently before a closing process of the first furniture part defines the predetermined position for an opening process which follows the closing process. This allows the predetermined position to be matched to the movement actually carried out most recently by the first furniture part. The effort for readjustment of the predetermined position by an operator can thus be minimized, or self-adjustment can be achieved without any adjustment effort for the predetermined position. Furthermore, the arrangement reacts in a manner adapted to the actual situation in use in that the monitoring unit notes, for example, the position most recently deliberately moved to by the first furniture part, and the first furniture part is moved to this position during the next movement process. This therefore effectively allows a semi-automatic system to be produced.

In a further preferred embodiment of the invention, the monitoring unit is designed such that, if the stopping position which was most recently assumed by the first furniture part before the closing process is an open position which can be reached without being driven or in a driven manner, the predetermined position which is derived from the open position is a position which is offset through a definable movement distance from the open position. This measure makes it possible to take account of the fact that an open position may exist in which the first furniture part remains in a permanent parked position. A parked position such as this may be set, for example, for repair or cleaning purposes or for a process of loading or unloading the first furniture part that takes a comparatively long time. However, this parked position, which is defined by way of example by means of a mechanical stop, generally cannot be reached by being moved to in a driven manner, but is set, for example manually, by the operator. However, this would result in the situation in which this open position would not be able to be reached at all in a driven manner during an opening process, following the closing process, as the predetermined position. It is therefore advantageous in this situation for the predetermined position which is derived from the open position or the parked position to be a position which is offset through a definable movement distance, for example through about 10 mm, from the parked position.

However, it is also feasible for the stopped position assumed most recently before the closing process to be an open position which can be reached in a driven manner, and for the predetermined position or stopped position derived from this to be offset through a movement distance during the next opening process to this most recent stopped position.

It is also possible that a control mechanism is provided, on whose operation by an operator the first furniture part moves further from the predetermined position. This allows the first furniture part to be moved individually from the assumed predetermined position, or to be moved further backwards or forwards, in particular without always having to work with a defined identical time interval after which the first furniture part is moved further from the predetermined position.

In one preferred embodiment of the invention, an adjusting mechanism is provided for variable adjustment of the predetermined position. A suitable adjusting means allows the predetermined position to be adjusted at any time, or to be adapted or changed subsequently, and in particular to be matched to individual presets. In principle, the control means can also be used in a combined manner, in particular to preset the variable time.

It is furthermore preferable that the adjusting means be designed to adjust the predetermined position by a movement, which is carried out manually, of the first furniture part. For example, it is possible for a position or possibly a plurality of predetermined positions, and linked thereto, also times and movement patterns of the first furniture part to be carried out in a particularly simple manner by a manual movement of the relevant first furniture part. Furthermore, in this case, the manual movement, which is carried out for adjustment purposes, of the first furniture part can in this case be assessed directly, and can be adapted, by the person carrying it out, while doing so. Advantageously, there is no need to first of all wait for the appropriate device or monitoring unit to be addressed by appropriate devices or control commands.

In one advantageous embodiment of the invention, the adjusting means is designed such that a plurality of predetermined positions can be set for the first furniture part. This also allows a relatively complex movement to a plurality of stopping positions along a movement path of the first furniture part to be selected for the first furniture part. The plurality of predetermined positions means that the first furniture part is moved to the respectively predetermined position, and is stopped there. The further movement of the first furniture part from one predetermined position to a next can, as explained above, be carried out in a different manner, for example after a specific time period has elapsed or, for example, by operation of an appropriate control means.

The invention also relates to a piece of furniture having furniture parts which can be moved relative to one another and which has one of the above-mentioned devices. This allows the stated advantages and features of the device for controlling movement of furniture parts which can be moved with respect to one another to be provided for an appropriately equipped piece of furniture. In particular, the pieces of furniture comprise movable furniture parts such as drawers, doors (having vertical hinge axes), hatches (having horizontal hinge axes) and the like, which are guided such that they can move via suitable guide devices on a second furniture part, in particular a furniture housing. In particular, guide rails may be used as guide devices for drawers, and fittings or hinges may be used in particular for doors or hatches.

BRIEF DESCRIPTION OF THE DRAWINGS

Further advantages and features of the invention will be explained in more detail with reference to the schematically illustrated figures.

DETAILED DESCRIPTION OF THE INVENTION

Figure 1:
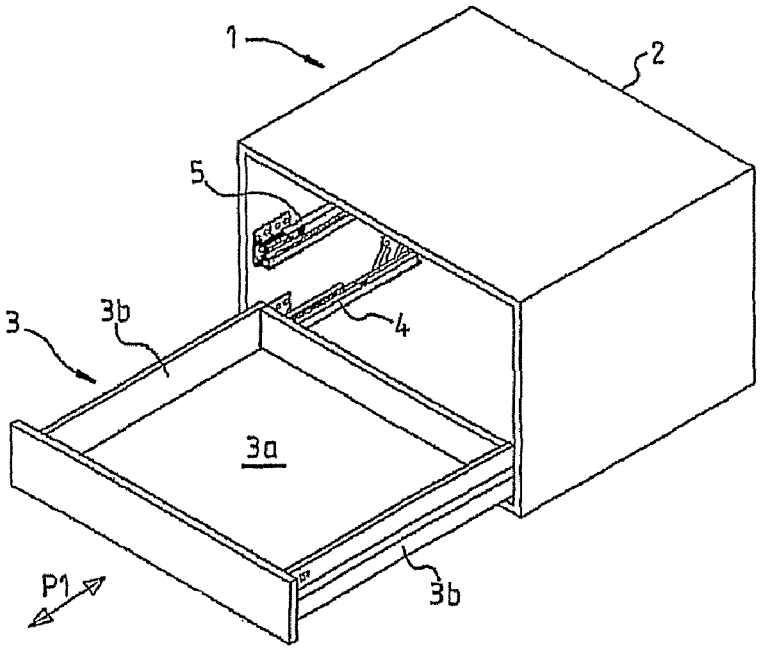
FIG. 1 is a perspective view of a piece of furniture according to the invention with a drawer, which can be moved in a housing.

FIG. 1 shows, obliquely from above, a piece of furniture 1 according to the invention with a housing 2 and a drawer 3 which is guided such that it can move in the housing 2. The drawer 3 which is arranged in the lower area of the housing 2 is illustrated in the open or pulled-out state, with the drawer 3 being movable with respect to the housing 2 via a pulling-out fitting or a drawer guide 4. A further drawer, which is not illustrated, can be accommodated in the housing 2 via a further drawer guide 5, in a corresponding manner to the drawer 3. The drawer 3 can be moved, that is to say it can be pulled out or pushed in, relative to the housing 2 as indicated by the double-headed arrow P1. In order to hold and/or guide the movement of the drawer, the drawer guide 4 is fitted on each of the drawer sides in the lower area of drawer frames 3*b* which project upwards on both sides on the drawer bottom 3*a*. FIG. 1 respectively shows only the drawer guides 4 and 5 which are attached to an inner face of the housing that can be seen. The drawer 3 can be moved in a driven manner, in which case the drive unit (not shown) can be arranged, for example, in the rear area of the housing or on the drawer guides 4, 5.

Figure 2:
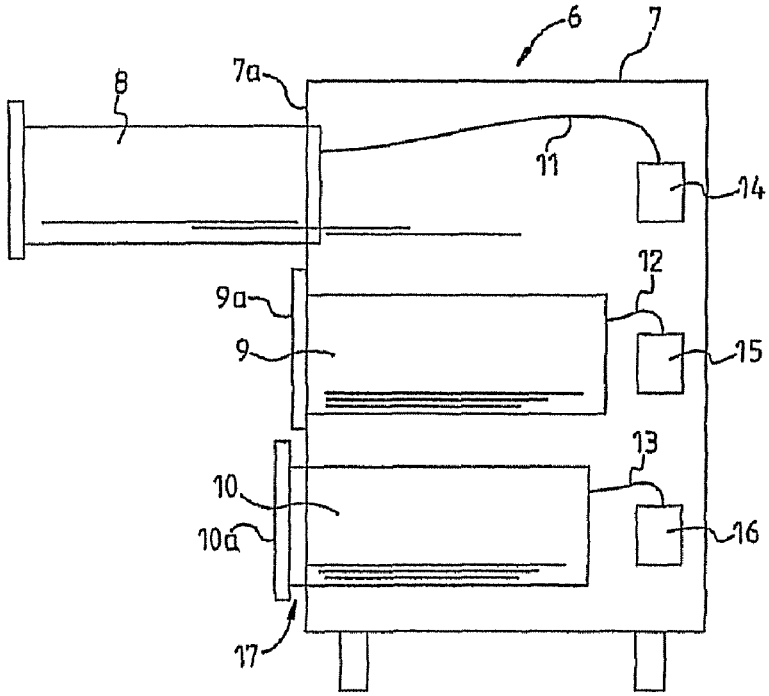
FIG. 2 shows a highly schematic section view from the side through a further embodiment of a piece of furniture according to the invention with a drawer which can be moved in a driven manner in a housing.

FIG. 2 shows a highly simplified and schematic illustration in the form of a side view of a further piece of furniture 6 according to the invention with a housing 7, with one side wall of the housing 7 having been omitted. Three drawers 8, 9 and 10 which are arranged one above the other and can be moved in a driven manner are accommodated in the housing 7. The drawers 8, 9 and 10 or their parts moving with them are connected via respective drive elements 11, 12 and 13 to drive units 14, 15 and 16, which are respectively associated with each of the drawers 8, 9 and 10. For this purpose, each of the drive elements 11, 12 and 13 on the one hand acts on a rear wall of each respective drawer 8, 9 and 10 and their rear walls, and on the other hand on each respective drive unit 14, 15 and 16.

The drawer 8 is shown in an open position, or in a state in which it has been moved out of the housing 7. The drawer 9 is illustrated in a closed position, or in a state in which it is located completely in the housing 7, with a drawer front 9*a* resting against a front edge 7*a* of the housing, in such a manner that the front edge 7*a* forms a mechanical stop for the drawer front 9*a*.

The drawer 10 is moved out by a comparatively short distance, over a distance 17 between a drawer front 10*a* and the front edge 7*a*. This distance may be required, for example, for push-operation of the drawer 10, for example when the drawer 10 can be operated by means of a so-called touch-latch system (not shown). In order to open the drawer 10, it is moved through a short movement distance in the direction of the housing 7 by pressing on the drawer front 10*a*, as a result of which, after an initiation action by the monitoring unit, the drive unit 16 moves the drawer 10 out of housing 7, in a driven manner via the drive element 13.

The monitoring unit for monitoring the movement of the drawers 8, 9 and 10, and individual monitoring units which are associated with each drawer 8, 9 and 10 and which communicate with one another, are not illustrated in FIG. 2. However, by way of example, the monitoring unit can be accommodated in each of the drive units 14, 15 and 16.

List of Reference Symbols:

1 Piece of furniture
2 Housing
3 Drawer
3*a* Drawer bottom
3*b* Drawer frame
4 Drawer guide
5 Drawer guide
6 Piece of furniture
7 Housing
7*a* Front edge of 7

8 Drawer
9 Drawer
9*a* Drawer front
10 Drawer
10*a* Drawer front
11 Drive element
12 Drive element
13 Drive element
14 Drive unit
15 Drive unit
16 Drive unit
17 Distance

We claim:

1. A device for controlling the movement of a first furniture part relative to a second furniture part, comprising a drive unit to move the first furniture part relative to the second furniture part, a monitoring unit for monitoring the movement of the first furniture part, and an adjustment mechanism for variable adjustment of a predetermined position, wherein after an initiating action by the monitoring unit, the drive unit and monitoring unit cooperatively move the first furniture part to the predetermined position that differs from a final position of the first furniture part, and wherein the monitoring unit stops the first furniture part during the movement to the predetermined position, before reaching the predetermined position.

2. A device for controlling the movement of a first furniture part relative to a second furniture part, comprising a drive unit to move the first furniture part relative to the second furniture part and a monitoring unit for monitoring the movement of the first furniture part, wherein after an initiating action by the monitoring unit, the drive unit and the monitoring unit cooperatively move the first furniture part to a predetermined position that differs from a final position of the first furniture part, and wherein the monitoring unit uses a stopping position which was assumed most recently by the first furniture part before a closing process of the first furniture part as the predetermined position for an opening process which follows the closing process.

3. The device as claimed in claim 1, wherein the drive unit and the monitoring unit cooperatively move the first furniture part in a driven manner to the predetermined position.

4. The device as claimed in claim 1, wherein the drive unit and monitoring unit cooperatively move the first furniture part in a driven manner over a distance that is less than a maximum distance that the first furniture part can move relative to the second furniture part.

5. The device as claimed in claim 1, wherein the drive unit and the monitoring unit cooperatively move the first furniture part from a closed position to the predetermined position.

6. The device as claimed in claim 1, wherein the drive unit and the monitoring unit cooperatively move the first furniture part from the predetermined position to a further position.

7. The device as claimed in claim 6, wherein the further position is a predetermined position which differs from the final position of the first furniture part.

8. The device as claimed in claim 6, wherein the further position is the final position of the first furniture part.

9. The device as claimed in claim 6, wherein the further position is a position between a closed position and an open position of the first furniture part.

10. The device as claimed in claim 1, wherein a stopping position which was most recently assumed by the first furniture part before a closing process is an open position that is reached without driving the first furniture part, and the predetermined position is defined as a position which is offset through a definable movement distance from the open position.

11. The device as claimed in claim 1, further comprising a control mechanism on whose operation by an operator moves the first furniture part from the predetermined position.

12. The device as claimed in claim 1, wherein the adjustment mechanism allows for adjustment of the predetermined position by a manual movement of the first furniture part.

13. The device as claimed in claim 1, wherein the adjustment mechanism allows for a plurality of predetermined positions to be set for the first furniture part.

14. A piece of furniture comprising a device as claimed in claim 1.

* * * * *